US009528343B2

(12) United States Patent
Jordan et al.

(10) Patent No.: US 9,528,343 B2
(45) Date of Patent: Dec. 27, 2016

(54) DEGRADABLE BALL SEALER

(71) Applicant: Parker-Hannifin Corporation, Cleveland, OH (US)

(72) Inventors: Stephen W. Jordan, North Haven, CT (US); Kenneth W. Cornett, Ivoryton, CT (US); Paul A. Dudzinski, East Berlin, CT (US)

(73) Assignee: Parker-Hannifin Corporation, Cleveland, OH (US)

( * ) Notice: Subject to any disclaimer, the term of this patent is extended or adjusted under 35 U.S.C. 154(b) by 596 days.

(21) Appl. No.: 13/916,905

(22) Filed: Jun. 13, 2013

(65) Prior Publication Data

US 2014/0196899 A1 Jul. 17, 2014

Related U.S. Application Data

(60) Provisional application No. 61/753,454, filed on Jan. 17, 2013.

(51) Int. Cl.

| | |
|---|---|
| ***B32B 15/01*** | (2006.01) |
| ***E21B 33/138*** | (2006.01) |
| ***C22C 1/04*** | (2006.01) |
| ***C22C 1/10*** | (2006.01) |
| ***C22C 32/00*** | (2006.01) |

(52) U.S. Cl.

CPC ..... *E21B 33/138* (2013.01); *C22C 1/0416* (2013.01); *C22C 1/1036* (2013.01); *C22C 32/00* (2013.01)

(58) Field of Classification Search

None

See application file for complete search history.

(56) References Cited

U.S. PATENT DOCUMENTS

| | | | | |
|---|---|---|---|---|
| 4,573,517 | A | 3/1986 | Booth et al. | |
| 5,322,109 | A | 6/1994 | Cornie | |
| 5,553,658 | A | 9/1996 | Cornie | |
| 5,983,973 | A | 11/1999 | Cornie | |
| 5,990,051 | A | 11/1999 | Ischy et al. | |
| 6,148,899 | A | 11/2000 | Cornie et al. | |
| 6,398,882 | B1 * | 6/2002 | Chu | C22C 32/0052 148/437 |
| 7,647,964 | B2 | 1/2010 | Akbar et al. | |

(Continued)

FOREIGN PATENT DOCUMENTS

| | | | |
|---|---|---|---|
| WO | 2012/097235 | A1 | 7/2012 |
| WO | 2012/138517 | A2 | 10/2012 |
| WO | 2013/015992 | A2 | 1/2013 |

OTHER PUBLICATIONS

International Search Report and the Written Opinion for corresponding International Application No. PCT/US2013/046264 dated Jul. 28, 2014.

*Primary Examiner* — Daniel J Schleis

(74) *Attorney, Agent, or Firm* — Renner, Otto, Boisselle & Sklar, LLP

(57) ABSTRACT

High strength, degradable ball sealer for temporarily sealing off lower zones in a wellbore from the flow of a fluid injected into the well. The degradable ball sealer may also seal openings formed through slidable packers or sleeves received within a tubing string in the well, from the flow of a fluid injected into the well. The ball sealer includes an aluminum-based alloy matrix containing gallium, with graphitic carbon particulate and salt particulate homogeneously distributed within the aluminum-based alloy matrix.

8 Claims, 5 Drawing Sheets

(56) References Cited

U.S. PATENT DOCUMENTS

| | | | | |
|---|---|---|---|---|
| 8,127,856 | B1 | 3/2012 | Nish et al. | |
| 8,211,247 | B2 * | 7/2012 | Marya | C09K 8/805 148/400 |
| 2007/0007007 | A1 | 1/2007 | Themig et al. | |
| 2007/0169935 | A1 | 7/2007 | Akbar et al. | |
| 2008/0105438 | A1 | 5/2008 | Jordan et al. | |
| 2009/0226340 | A1 | 9/2009 | Marya | |
| 2010/0209288 | A1 | 8/2010 | Marya | |
| 2011/0067889 | A1 | 3/2011 | Marya et al. | |
| 2011/0132143 | A1 | 6/2011 | Xu et al. | |
| 2011/0132612 | A1 | 6/2011 | Agrawal et al. | |
| 2011/0132619 | A1 | 6/2011 | Agrawal et al. | |
| 2011/0132621 | A1 | 6/2011 | Agrawal et al. | |
| 2011/0135530 | A1 | 6/2011 | Xu et al. | |
| 2011/0135953 | A1 | 6/2011 | Xu et al. | |
| 2011/0136707 | A1 | 6/2011 | Xu et al. | |
| 2012/0024109 | A1 | 2/2012 | Xu et al. | |
| 2012/0103135 | A1 | 5/2012 | Xu et al. | |
| 2012/0107590 | A1 | 5/2012 | Xu et al. | |
| 2012/0118553 | A1 | 5/2012 | Chang et al. | |
| 2012/0181032 | A1 | 7/2012 | Naedler et al. | |
| 2013/0029886 | A1 | 1/2013 | Mazyar et al. | |

* cited by examiner

DEGRADABLE BALL SEALER

CROSS REFERENCE TO RELATED APPLICATIONS

The present application claims the benefit of the filing date of U.S. Provisional Application No. 61/753,454, filed Jan. 17, 2013, the disclosure of which is incorporated herein by reference in its entirety.

FIELD OF THE INVENTION

The present invention relates broadly to ball sealers used to restrict or direct pressurization within wellbores to specific regions, segments and manufactured articles, or to mechanically engage and/or activate downhole devices. More particularly, the present invention relates to degradable ball sealer compositions, methods of their manufacture and methods of using the ball sealers to mechanically engage seated segments of engineered articles to temporarily seal defined regions within wellbores.

BACKGROUND

Hydraulic fracturing, commonly referred to as "fracking", is a process in which a wellbore is pressurized to fracture hydrocarbon bearing geologic formations. Pressurization is typically incremented sequentially in discrete zones along the wellbore. Following the fracturing process, the pressure containment apparatus within each zone must be unsealed so as to allow flowback of the released hydrocarbons back through the wellbore.

Processes applied to achieve the depressurization and allow flowback often required that the containment apparatus be drilled out, or otherwise mechanically removed, which is cumbersome and expensive.

SUMMARY

The present invention is directed to a degradable ball sealer construction that is both light weight and high strength. Such construction is particularly adapted for use in high pressure, multistage hydraulic fracturing operations.

In a first aspect of the invention, there is provided a degradable article constructed from a high strength material that includes an aluminum-based alloy matrix containing gallium; and a plurality of carbon particles and a plurality of salt particles homogeneously distributed within the aluminum-based alloy matrix, wherein the concentration of gallium in the degradable article is highest at the outermost surface of the degradable article and the article is galvanically corrodible.

In an embodiment, the salt is selected from among metal halides, metal sulphides and metal carbonates, wherein the metal comprises one or more of lithium, sodium, potassium, beryllium, magnesium, calcium and strontium.

In an embodiment, the high strength material comprises 10 to 35 percent by weight carbon, 3 to 25 percent by weight salt, 1 to 10 percent by weight gallium, and 45 to 85 percent by weight aluminum-based alloy.

In an embodiment, the gallium is almost entirely distributed within the primary phase grains of the aluminum alloy matrix.

In an embodiment, at least 95 weight percent of the gallium is incorporated within aluminum grains.

In an embodiment the degradable article is generally spherical.

In an embodiment, the degradable article is a ball sealer for sealing an opening in a well from the flow of a fluid in the well, and the ball sealer is galvanically corrodible in the well so as to be dissolvable.

In another aspect of the invention, there is provided method of forming a reversible downhole seal with a corrodible ball sealer, the method including: seating the degradable ball sealer in a downhole article configured to accommodate a surface shape of the ball sealer, the ball sealer constructed of a high strength material that includes: an aluminum-based alloy matrix containing gallium; and a plurality of carbon particles and a plurality of salt particles homogeneously distributed within the aluminum-based alloy matrix, wherein the concentration of gallium in the ball sealer is highest at the outermost surface of the ball sealer; and wherein the degradable ball sealer prevents fluid flow when seated.

In one embodiment of the method, seating the degradable ball sealer includes placing the ball sealer in a downhole environment and applying pressure to the downhole environment.

In one embodiment, the method further includes unseating the ball sealer by reducing the pressure applied to the downhole environment to a pressure below that of an ambient downhole pressure.

In one embodiment, the method further includes corroding the ball sealer.

In another aspect of the invention there is provided A method of making a high strength, degradable article, the method including: (a) forming a compacted preform from a powder mixture that includes a plurality of carbon particles, a plurality of salt particles and a binding agent; (b) heating the compacted preform to remove the binding agent and create a plurality of pores within the preform; (c) infiltrating the pores of the preform with an aluminum-based alloy to form an article including an aluminum-based alloy matrix with carbon particulate and salt particulate distributed within the aluminum-based alloy matrix; and (d) diffusing gallium into the aluminum-based alloy matrix, wherein the concentration of gallium in the article is highest at the outermost surface of the article and the article is galvanically corrodible.

In one embodiment of the method, the powder mixture further includes gallium.

In further aspect of the invention there is provided a method of reversibly sealing an opening in a well from the flow of a fluid in the well, the fluid having a specific gravity, and the method including the steps of: (a) injecting into the well a ball sealer formed of a high-strength metallic material, the material including an aluminum-based alloy matrix containing gallium; and a plurality of carbon particles and a plurality of salt particles homogeneously distributed within the aluminum-based alloy matrix, wherein the concentration of gallium in the ball sealer is highest at the outermost surface of the ball sealer; and (b) galvanically corroding the material so as to dissolve the ball sealer.

BRIEF DESCRIPTION OF THE DRAWINGS

For a fuller understanding of the nature and objects of the invention, reference should be had to the following detailed description taken in connection with the accompanying drawings wherein.

Figure 1A:
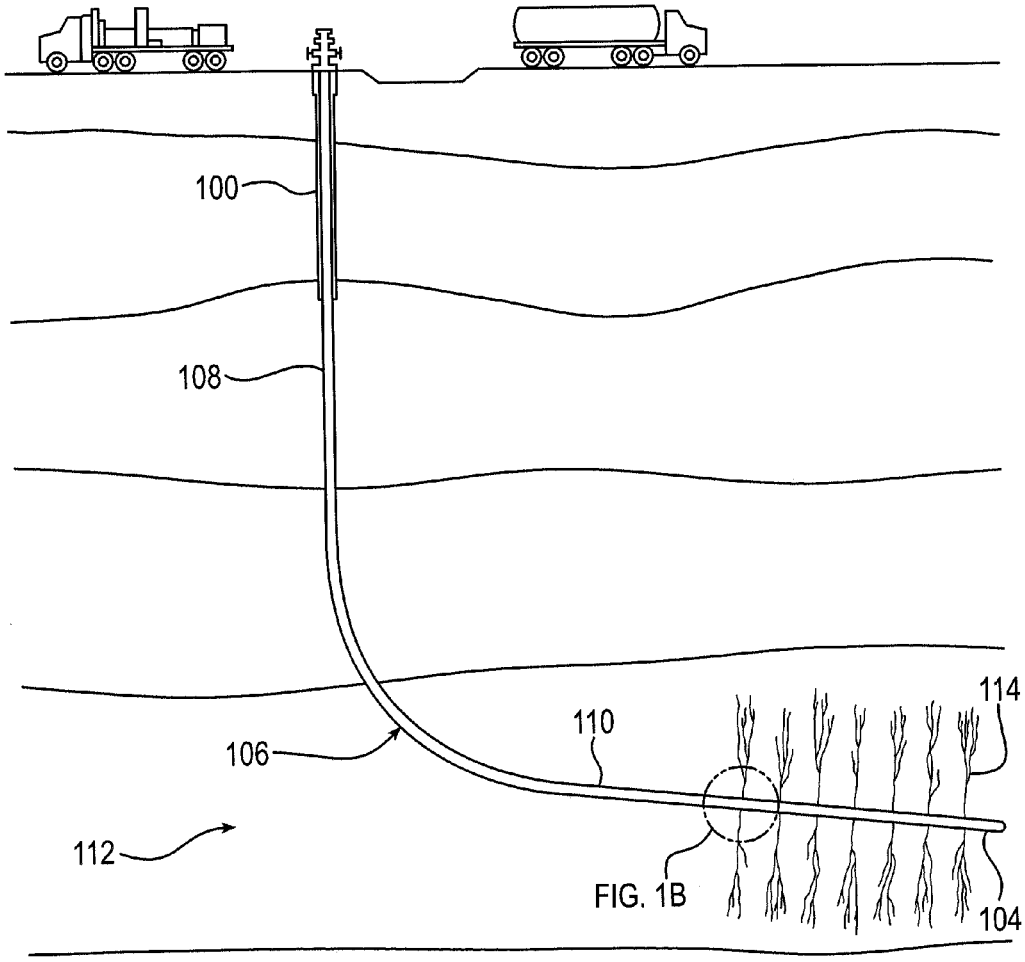
FIG. 1A is a cross-section view of an exemplary embodiment of a hydraulic fracturing installation in which the degradable ball sealer of the present invention is used.

The drawings will be described further in connection with the following Detailed Description.

DETAILED DESCRIPTION

As used herein, the term "degradable" refers to compositions that are partially or wholly consumed because of their relatively high reactivity. Compositions of the present invention that are considered reactive and degradable include those that are partially or wholly dissolvable (soluble) in the designated fluid environment, as well as those that disintegrate but do not necessarily dissolve.

The term "ball", as used herein, extends beyond that typically associated with spherical shapes, and is intended to include other geometries. The ball may be any shape that can traverse at least a portion of a well bore to engage and hermetically seal an engineered wellbore orifice. Suitable shapes include, for example, cylindrical, round, bar, dart and the like.

In the figures, elements having an alphanumeric designation may be referenced herein collectively or in the alternative, as will be apparent from context, by the numeric portion of the designation only. Further, the constituent parts of various elements in the figures may be designated with separate reference numerals which shall be understood to refer to that constituent part of the element and not the element as a whole. General references, along with references to spaces, surfaces, dimensions, and extents, may be designated with arrows or underscores.

Figure 1B:
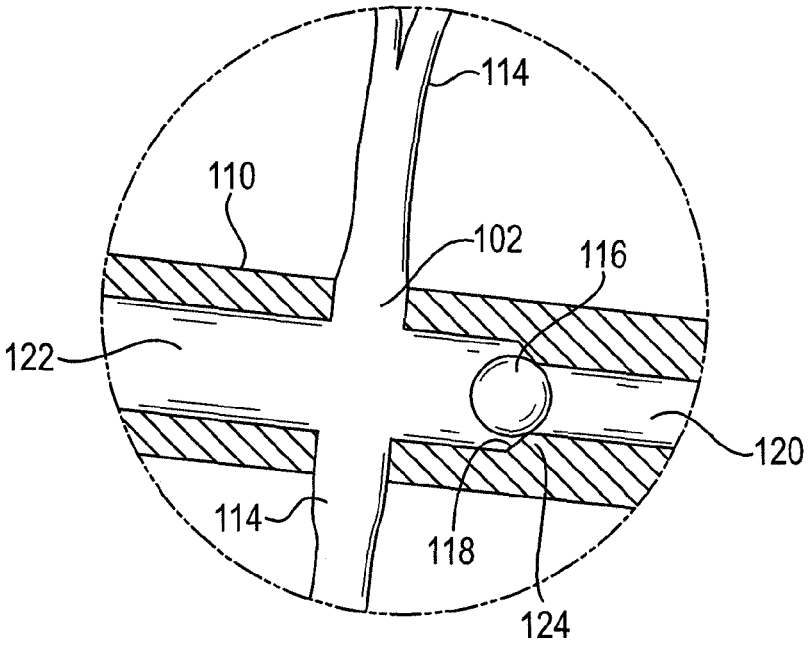
FIG. 1B is a close-up view of a cross section of the wellbore of FIG. 1A showing the seated ball sealer.

Referring to FIGS. 1A and 1B, the use of the degradable ball sealers of the present invention in an exemplary horizontal fracturing operation is illustrated. A wellbore 100, which may be composed of joints of steel casing, either cemented or uncemented, is set into place at the conclusion of the drilling process. Perforations 102 are made near the end of the well, commonly referred to as the toe 104. Fracturing fluid made up of water, sand and additives is mixed at the surface and pumped at high pressures down the vertical wellbore 108 into the horizontal well bore 110. The fracturing fluid flows through the perforations 102 of the horizontal wellbore 110 and into the surrounding formation 112, typically a shale formation, fracturing it while carrying sand or proppants into the fissures 114 to hold them open. The fracturing process is typically completed in multiple sections of the horizontal wellbore 110, commonly referred to as stages. Once a stage is finished, the stage is isolated using a seated ball sealer 116 within the wellbore to temporarily seal off that section. The next section of the wellbore is then perforated and another stage is then pumped and pressurized. The pressure within the isolated section 120 is lower than in the section of the wellbore in the subsequent stage 122. The "perf and plug" process is repeated as necessary along the entire length of the horizontal part of the wellbore 110, beginning at the toe 104 and ending at the heel 106.

Referring to FIG. 1B, the ball sealer 116 acts to plug horizontal wellbore 110 at a sealing point 124 where the diameter is reduced with respect to the diameter of wellbore pipe. At the sealing point 124, the ball sealer 116 is mated to a precisely engineered ball seat 118, much like a valve seat for a check valve. The ball sealer 116 is injected into the well and the pressure from above the sealing point will force the ball sealer 116 down against the tapered ball seat 118, thereby restricting fluid flow past the sealing point 124. On the isolated section 120 side of the ball seat 118, the pressure within the wellbore is low and on the opposite side 122 of the ball seat 118, the pressure within the wellbore is high due to the presence of the fracking fluid within this section of the wellbore.

Figure 2:
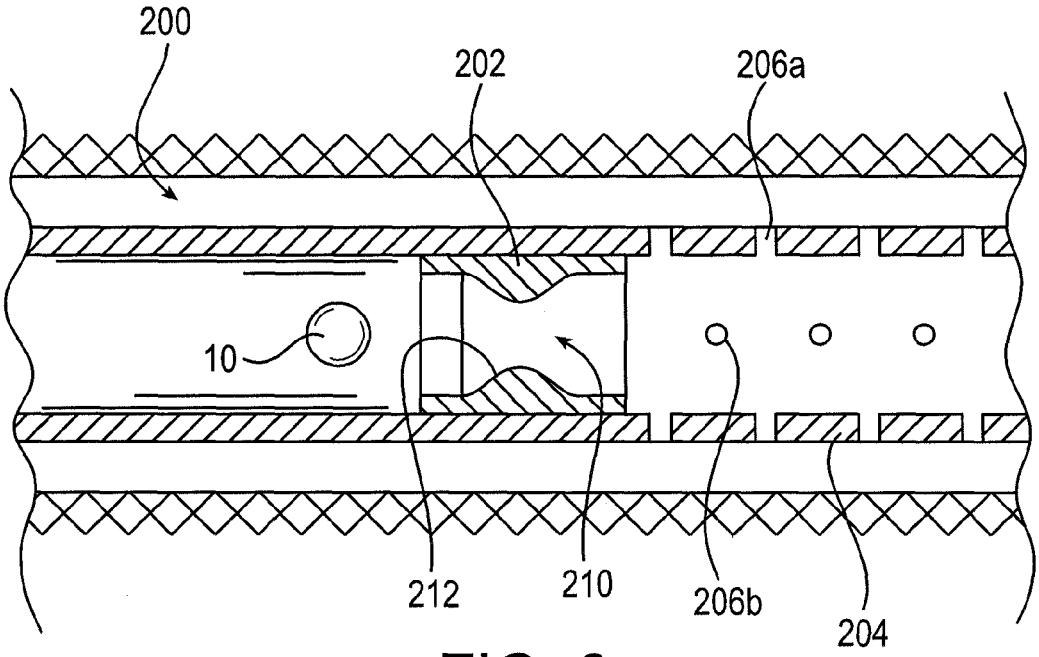
FIG. 2 is a cross-section view of a section of a horizontal wellbore showing the use of the degradable ball sealer of the present invention with an illustrative movable packer in an open hole, multistage fracturing operation.

The ball sealers of the present invention also may be used to seal openings in other well structures or components such as the sliding sleeves or packers used in newer stimulation operations of multistage fracturing which is further described in U.S. Patent Publication No. 2007/0007007. With reference to FIG. 2, such operation, which typically is employed in horizontal wellbores, a section of which is referenced at 200, utilizes a slidably movable packer or sleeve 202 to isolate sections of a tubing string 204 having a series of perforations, two of which are referenced at 206*a-b*, which may be distributed in different zones along the tubing string 204. Packer 202 has a passageway, referenced at 210, therethrough which narrows to form an internal opening 212, which may be sealed by ball sealer 10 of the present invention seating therein responsive to the flow of an injection or other fluid in the wellbore 200.

In one embodiment of the present invention, there is provided a degradable ball sealer that acts as a temporary check valve, engineered to perform three tasks to achieve hydraulic fracturing and hydrocarbon release in a superior manner.

The first task is to deliver the ball sealer to the desired sealing point. The desired sealing point is a tapered segment where the diameter is reduced with respect to the wellbore pipe. The sealing ball in its sealing condition is then "seated" upon this reduced diameter article. In one embodiment of the invention, this requires that the ball be nearly perfectly spherical, and have a specific gravity close to the specific gravity of the wellbore fluid, which may, for example, be in the range of about 1 to 2 g/cc, so that the ball sealer does not get trapped upon deployment to the appropriate sealing segment within the wellbore. In this embodiment, about ten to about forty segments may be arranged sequentially along the wellbore with decreasing seat diameter corresponding to increased distance from the heel of wellbore.

The second task of the degradable ball sealer is to function as a check valve and hold pressure. The more pressure held, the more desirable the ball sealer becomes, because more pressure causes greater fracturing over a larger area, thereby reducing the number of stages, and increasing the productive volume surrounding the wellbore shaft. The ball should also be as strong as possible because of seat overlap. Seat overlap is the difference between the ball diameter and the diameter of the smaller pipe. The smaller the overlap is, the more seats, and thus zones, are possible, but, when pressurized, the shear stresses on the ball are increased as the overlap is reduced, therefore requiring the greatest possible strength from the ball. "Strength" is a complex combination of tensile, shear and compressive strengths that varies with loading and overlap.

The third task of the degradable ball sealer is to be self-removing. Because drilling the ball out is expensive and cumbersome, it is advantageous to employ a ball sealer that dissolves after the job of hydraulic fracturing has been completed. It is of further value to have a ball sealer that dissolves in an environmentally friendly fluid, most notably, one that is of a generally neutral PH.

The degradable ball sealers of the present invention are formed from a high strength material that includes carbon, an aluminum-based alloy, gallium and salt, wherein the concentration of gallium in the degradable ball sealer is greatest at the surface of the ball and parabolically decreases toward the center of the ball.

As used herein, the term "aluminum-based alloy" means commercially pure aluminum in addition to aluminum alloys wherein the weight percentage of aluminum in the alloy is greater than the weight percentage of any other component of the alloy.

A significant galvanic potential exists between both cast and wrought aluminum-based alloys and graphitic carbons. When graphitic carbon and aluminum-based alloy come into contact in an electrolyte, the aluminum-based alloy acts as an anode and the graphitic carbon acts as a cathode. The electropotential difference between the graphitic carbon and the aluminum-based alloy is the driving force for an accelerated attack on the aluminum-based alloy. The aluminum-based alloy anode dissolves into the electrolyte. A significant amount of graphitic carbon is required to both initiate and maintain the galvanic reaction to completion (i.e., exhaustion or near exhaustion of the aluminum-based alloy).

Gallium is known to catalyze the reaction of aluminum with water by disrupting the formation of a protective oxide layer. However, the amount of gallium required to initiate and maintain this reaction (typically on the order of 7% by weight) has a significant negative effect on the bulk material properties of the aluminum-based alloy.

It has been discovered that the combination of gallium and graphitic carbon, plus the addition of a salt, has a synergistic effect on the dissolution/degradation of aluminum-based alloys when cast in situ. This synergy allows for the construction of a high-strength, aluminum composite alloy that is also highly susceptible to accelerated galvanic corrosion, permitting its use as a base material for dissolvable hydraulic fracturing balls.

Figure 3:
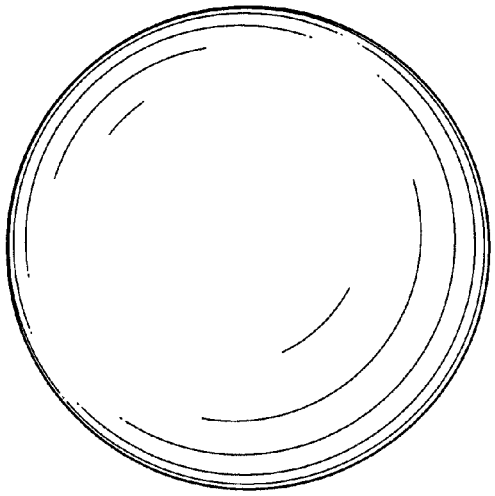
FIG. 3 is a perspective view of a degradable ball sealer in accordance with the present invention.

Referring to FIG. 3, an embodiment of a degradable ball sealer that is nearly perfectly spherical in shape is illustrated. The ball sealer may include a 35 to 65 percent volumetrically solid preform infiltrated by a metal alloy to achieve a 70% to 98% volumetrically solid composite. The open volume may be supported by hollow glass or ceramic spheres. In one embodiment, the preform contains approximately 35 to 85 weight percent carbon, 10 to 50 weight percent salt, 0 to 10 weight percent gallium and 0 to 15 weight percent hollow glass or ceramic spheres. In another embodiment, the preform contains approximately 60 to 85 weight percent carbon, 10 to 30 weight percent salt, 0.01 to 5 weight percent gallium and 0 to 15 weight percent hollow glass or ceramic spheres. The infiltrating alloy is predominantly made up of aluminum, and may contain 1 to about 8 weight percent gallium. The exact ratios of constituent materials and specific metal/alloying elements can be modified to precisely tailor the desired properties of the product.

The degradable ball sealer may be fabricated using powder molding to form a carbon-containing preform, melt infiltrating the preform with an aluminum-based alloy, followed by a gallium diffusion step.

In an initial step, a carbon-containing preform is formed from a powder mixture that contains a plurality of carbon particles, a plurality of salt particles and a binding agent.

The carbon used is preferably a relatively pure activated carbon. Lower purity and lower surface area graphite, such as PAN derived fiber, have been found to provide less optimal galvanic reactions. Other forms of carbon such as graphene, buckyballs, nanotubes and diamond can be expected to improve strength, but may be considered cost prohibitive.

Useful salts include the Group IA or IIB metals with a halogen. Examples of such salts include those containing the metal ions lithium, sodium, potassium, magnesium or calcium combined with one or more halogens such as fluorine or chlorine. Examples of preferred salts include potassium chloride, lithium chloride and lithium fluoride. Such salts are further beneficial to the extent with which they wet the infiltrating aluminum-based alloy, act as an electrolyte in water, and dissolve readily in water, upon mechanical agitation in the presence of gallium, as in accordance with the process described herein. In one embodiment, sodium chloride, for example, is effective to wet 355 aluminum alloy doped with 0.01 to 0.03 weight percent strontium. A limiting potential for stratification due to differences in density indicates that the desired microstructure is achieved at a temperature that does not fully dissolve or liquefy the salt of the suitable particle size during metal alloy infiltration.

Gallium may be added to the powder mixture as a wetting agent for the non-metal particulate of the preform.

The binding agent used may include a heat fugitive binder. In one embodiment, the binding agent includes a wax-based binder known to those skilled in the art. Non-limiting examples of useful binding agents include polyethylene glycol, polypropylene wax or any thermoplastic or gelling binder. The addition of the binding agent serves to hold the carbon particulate and the salt particles together prior to the casting step. The binding agent, through its removal in a debinding process, creates the pores in the preform to be filled by the infiltrating aluminum-based alloy.

In one embodiment, the preform may be made by compacting the powder mixture into a ball by placing the powder mixture between the halves of a sizing mold to remove excess air. By compacting the preform, its may be accurately sized to fit in a casting mold.

The compacted preform may be placed between the halves of a casting mold and then heated to remove the binding agent. In the casting mold, the aluminum-based alloy matrix component is infiltrated into the preform. After being heated to a temperature above its liquidus temperature, the infiltrated aluminum-based alloy may be admitted in a molten state into the cavity of the casting mold. The casting and pressure casting of metal matrix materials is described in U.S. Pat. Nos. 4,573,517; 5,322,109; 5,553,658; 5,983,973; and 6,148,899, the contents of which are hereby incorporated by reference.

Following infiltration of the aluminum-based alloy into the preform, the ball sealer is cooled down and removed from the casting mold. The ball sealer may then be machined down to size.

In a diffusion step, gallium is diffused into the aluminum-based alloy grains from the exterior of the ball sealer into the interior of the ball sealer. In one embodiment, the ball sealer is ball milled with ceramic media, for example spherical cubic zirconia media, in the presence of liquid gallium. In one embodiment, the ball sealer is ball milled with liquid gallium at a temperature above 30° C. for approximately one hour. In one embodiment, the ball sealer may be milled with liquid gallium at a temperature within the range of 40 to 100° C., or within the range of 40-70° C., or within the range of 45-60° C.

The ball sealer is then heated to a temperature within the range of about 275-350° C., or about 315° C. for about two hours in an inert atmosphere to cause the gallium to diffuse into the grains of the aluminum-based alloy matrix.

Figure 4:
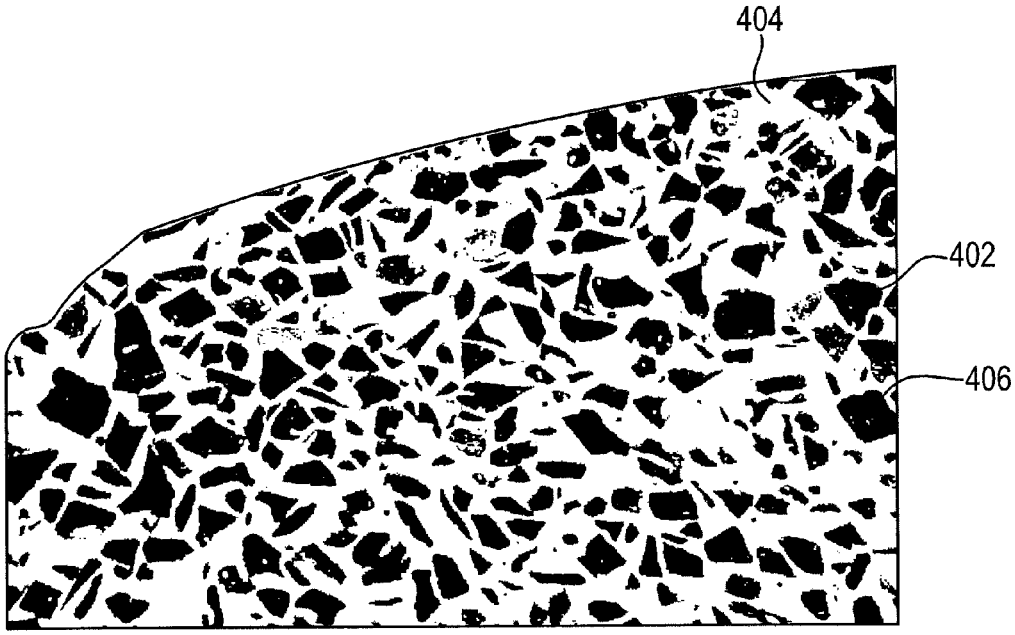
FIG. 4 is a magnified view of a cut and polished degradable ball sealer in accordance with the present invention.

Referring to FIG. 4, a magnified cross section photograph of a cut and polished degradable ball sealer shows the distribution of carbon particulate 402 and salt particulate 406 within the aluminum-based alloy containing matrix 404. The concentration of gallium within the alloy is highest in the outermost alloy grains and diminishes to an equilibrium level within the central bulk of the ball sealer.

Example 1

Figure 5A:
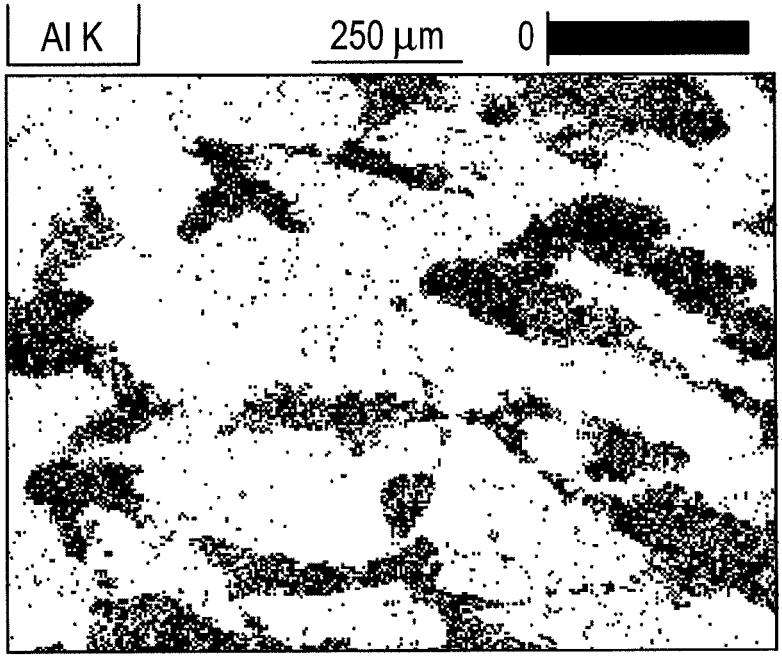
FIGS. 5A and 5B are metal ion maps of Al and Ga, respectively, of the degradable ball sealer of the present invention.
Figure 5B:
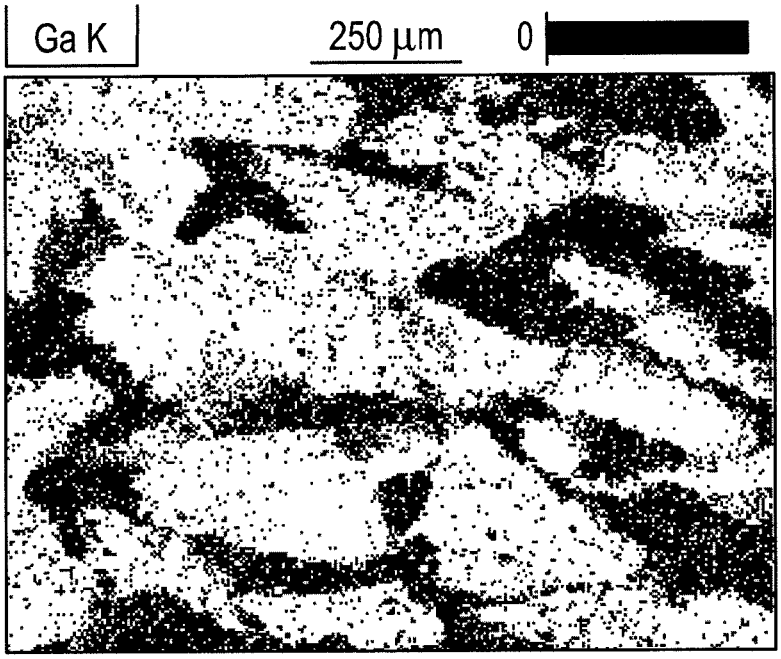

A ball sealer having a 3 inch diameter is formed from a 147 gram preform and 305 grams of an infiltrating aluminum alloy. The preform contains 107 grams of activated carbon particulate with an average particle size of 400 microns, 29 grams of sodium chloride with an average particle size of 250 microns and 11 grams of homogeneously, microscopically dispersed gallium. The infiltrating alloy is comprised of 300 grams of 355 type aluminum alloy, doped with 5 grams of gallium and 0.06 grams of strontium. The 5 grams of gallium considered to originate from the infiltrating alloy is nonlinearly dispersed, because it is diffused from the outside surface of the ball sealer into the bulk of the infiltrating alloy. The diffused gallium is nearly wholly incorporated into the aluminum grains, and little gallium is remnant in the grain boundaries as demonstrated by metal ion maps of aluminum and gallium produced by EDAX studies shown in FIGS. 5A and 5B, respectively.

Figure 6:
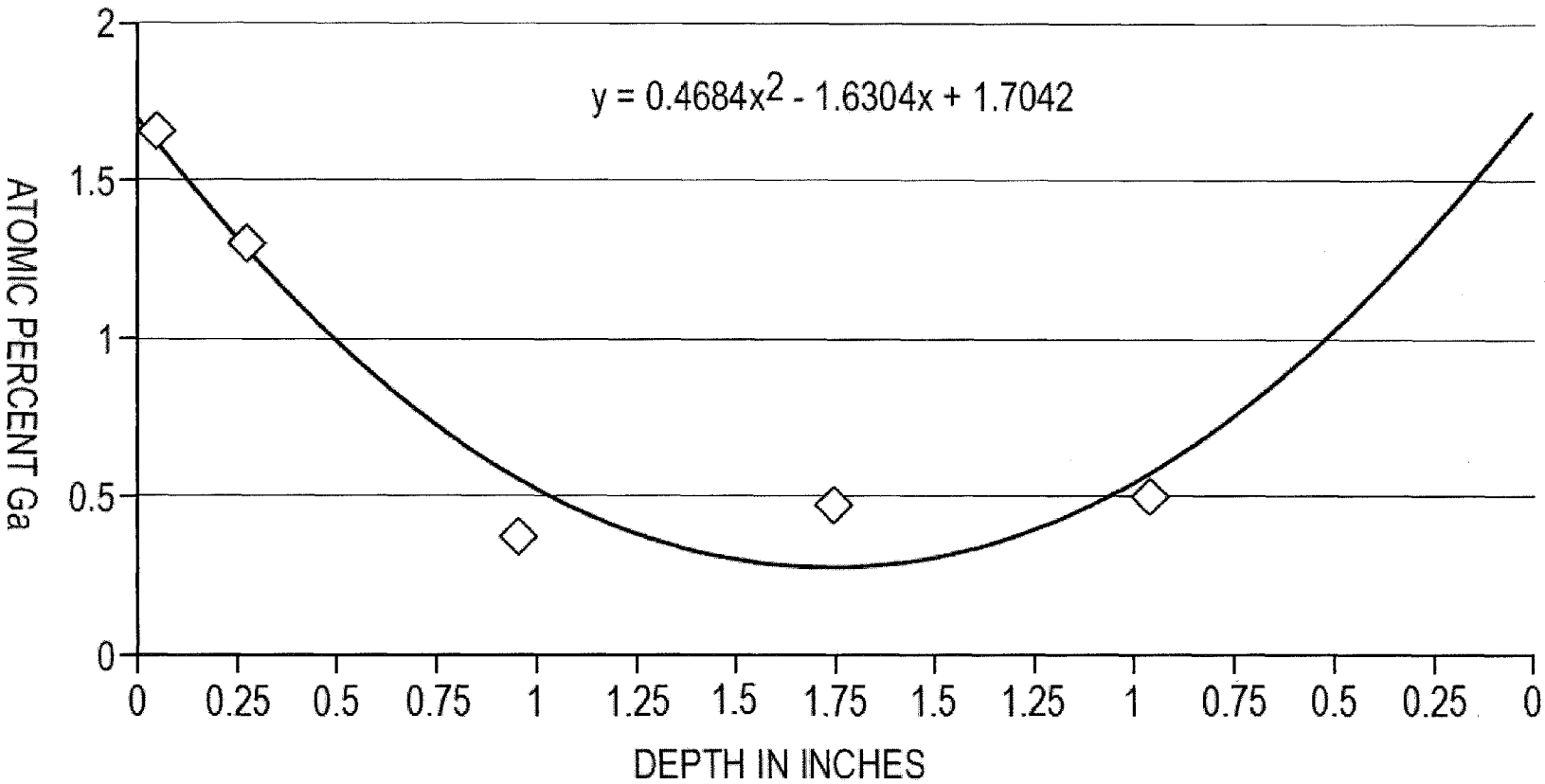
FIG. 6 is a graph of the concentration of Ga vs. depth of a 3.5 inch degradable ball sealer produced in accordance with the present invention.

Referring to FIG. 6, the concentration of gallium in a 3.5 inch diameter degradable ball sealer is shown to vary with the depth of diffusion into the ball sealer. The concentration of gallium is highest at the surface of the ball sealer and decreases parabolically as the distance from the surface increases.

The gallium diffused ball sealers produced in accordance with the present invention retain highly concentrated levels of gallium in the outermost grains of the aluminum-based alloy. This allows the ball sealers to achieve both the catalytic action where the reaction with water takes place, and simultaneously retain high strength within the bulk of the ball sealer. As dissolution proceeds, the gallium works its way into the ball, acting as a mobile catalyst, concentrating at the reaction front as the reaction proceeds. Because the gallium is not highly concentrated in the grain boundaries, the overall strength of the ball sealer is maintained.

Although the invention has been shown and described with respect to a certain embodiment or embodiments, it is obvious that equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A degradable article constructed of a high strength material comprising:

an aluminum-based alloy matrix containing gallium; and a plurality of carbon particles and a plurality of salt particles homogeneously distributed within the aluminum-based alloy matrix, wherein the concentration of gallium in the degradable article is highest at the outermost surface of the degradable article and the article is galvanically corrodible.

2. The degradable article of claim 1, wherein the salt is selected from among metal halides, metal sulphides and metal carbonates, wherein the metal comprises one or more of lithium, sodium, potassium, beryllium, magnesium, calcium and strontium.

3. The degradable article of claim 1 wherein the high strength material comprises 10 to 35 percent by weight carbon, 3 to 25 percent by weight salt, 1 to 10 percent by weight gallium, and 45 to 85 percent by weight aluminum-based alloy.

4. The degradable article of claim 1 wherein the high strength material comprises 15 to 20 percent by weight carbon, 5 to 20 percent by weight salt, 1 to 9 percent by weight gallium, and 55 to 80 percent by weight aluminum-based alloy.

5. The degradable article of claim 1 wherein the gallium is almost entirely distributed within the primary phase grains of the aluminum-based alloy matrix.

6. The degradable article of claim 5 wherein at least 95 weight percent of the gallium is incorporated within aluminum grains.

7. The degradable article of claim 1 wherein the ball sealer is generally spherical.

8. The degradable article of claim 1, wherein the article is a ball sealer for sealing an opening in a well from the flow of a fluid in the well, and the ball sealer is galvanically corrodible in the well so as to be dissolvable.

* * * * *